United States Patent [19]

Manini nee Gallichi

[11] 4,287,729

[45] Sep. 8, 1981

[54] CIRCULAR KNITTING MACHINES

[76] Inventor: Anna Manini née Gallichi, Via Pacini 43, Florence, Italy

[21] Appl. No.: 34,479

[22] Filed: Apr. 30, 1979

[30] Foreign Application Priority Data

May 3, 1978 [IT] Italy ..... 9444 A/78

[51] Int. Cl.[3] ..... D04B 15/92

[52] U.S. Cl. ..... 66/149 S

[58] Field of Search ..... 28/264; 66/147, 149 R, 66/149 S, 152, 153; 406/192

[56] References Cited

U.S. PATENT DOCUMENTS

| | | | |
|---|---|---|---|
| 2,183,835 | 12/1939 | Foulke | 406/192 X |
| 3,599,832 | 8/1971 | Smith | 406/192 X |
| 3,668,900 | 6/1972 | Peet | 66/149 S |
| 4,069,090 | 1/1978 | Boyer | 66/147 X |

FOREIGN PATENT DOCUMENTS

| | | | |
|---|---|---|---|
| 2157505 | 5/1972 | Fed. Rep. of Germany | 66/149 S |
| 2126388 | 12/1972 | Fed. Rep. of Germany | 66/149 S |
| 1296979 | 11/1972 | United Kingdom | 66/149 S |

*Primary Examiner*—Wm. Carter Reynolds

*Attorney, Agent, or Firm*—McAulay, Fields, Fisher, Goldstein & Nissen

[57] ABSTRACT

A circular knitting machine includes a pneumatic tensioning duct which receives the article being knitted on the rotating needle cylinder of the machine. In order to prevent the article from twisting in the duct during knitting of the article, the article is retained in a rotating portion of the duct by a very flexible tubular grid structure which is located in the rotating portion and which has a constriction to prevent passage of the article. At the end of knitting, the constriction in tubular grid structure is temporarily removed to permit passage of the article.

10 Claims, 15 Drawing Figures

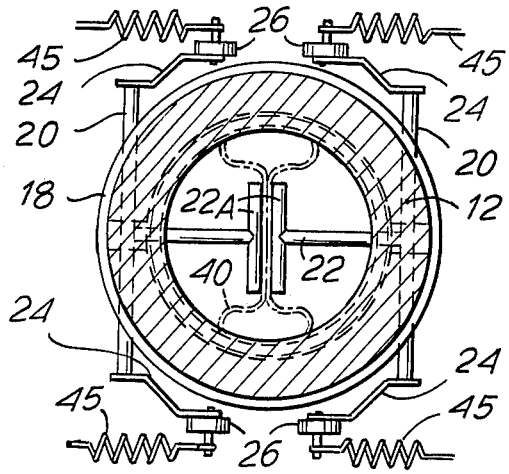
Fig. 4
Fig. 5
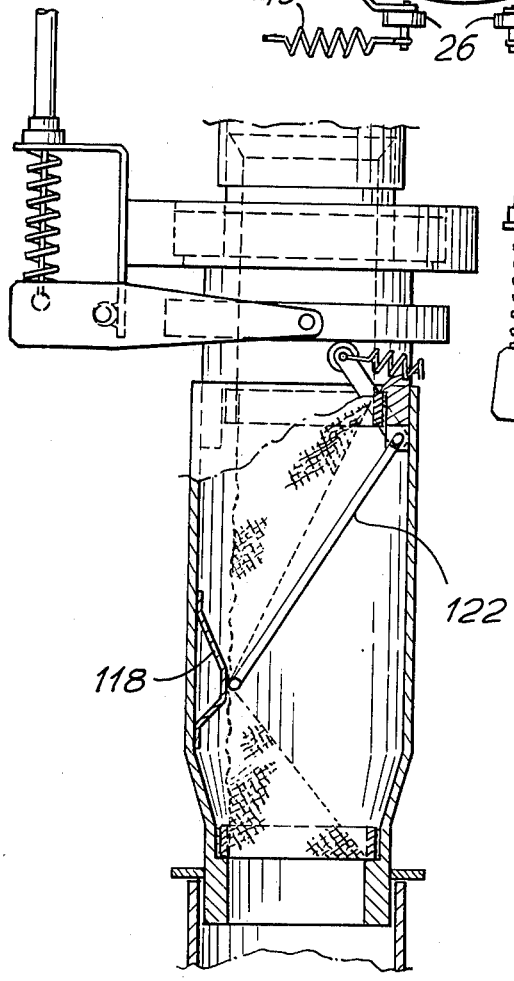
Fig. 6
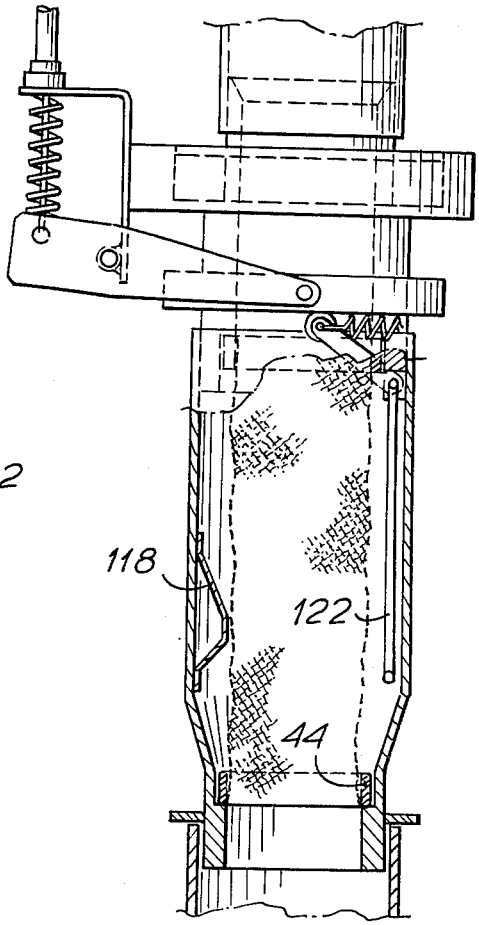

50
52
56
54
56
66A
52E
66
52A
66
76
74
76
72
X
X
52C
64
f7
f5
52
64
70
62
68A
52B
68A
52B
68
60

CIRCULAR KNITTING MACHINES

FIELD OF THE INVENTION

The present invention relates to circular knitting machines, and more particularly to a device for intercepting a knitted article in the rotating portion of a pneumatic tensioning duct while the article is being formed by the rotating needle cylinder of a circular knitting machine so as to prevent the article from twisting.

SUMMARY OF THE INVENTION

According to the invention, there is provided in a circular knitting machine, a rotating needle cylinder, a pneumatic tensioning duct along which an air current passes to tension an article being knitted, said duct comprising a rotating portion a flexible tubular grid structure in the rotating portion of the tensioning duct, and means operable to constrict the tubular structure so that it intercepts the article under formation, while the air current is maintained through the structure.

The tubular structure may be resiliently urged so that it distends axially.

In one embodiment, the constricting means comprises at least one movable member mounted on the wall of the rotating duct portion, and which when moved causes opposing zones of the structure to approach each other, thus tightening the structure. Two symmetrical movable members, which are movable symmetrically, can be provided. The movable member or members can be swing-mounted, and be operated by an annular element, which surrounds the duct and is displaced axially so that it acts on an outer arm of the movable member or of each of the movable members.

In another embodiment, the tubular structure which rotates with the duct, is at least at one end engaged with an angularly movable annular element for causing the structure to tighten and be constricted by torsion. This annular element can be resiliently urged so that it becomes advanced in the direction of rotation, to keep the tubular structure under torsion, and can be subjected to a braking action by external means so that it becomes displaced angularly, to cause the tubular structure to distend whereby the constriction is removed.

BRIEF DESCRIPTION OF THE DRAWINGS

Embodiments of the invention will now be described, by way of example only, with reference to the accompanying diagrammatic drawings, in which:

FIG. 4 is a section taken on line IV—IV of FIG. 2;

FIGS. 5 and 6 are fragmentary longitudinal sections of a modified embodiment of the device and respectively showing the device when intercepting passage of the article and when permitting passage of the article;

DESCRIPTION OF THE PREFERRED EMBODIMENTS

Figure 1:
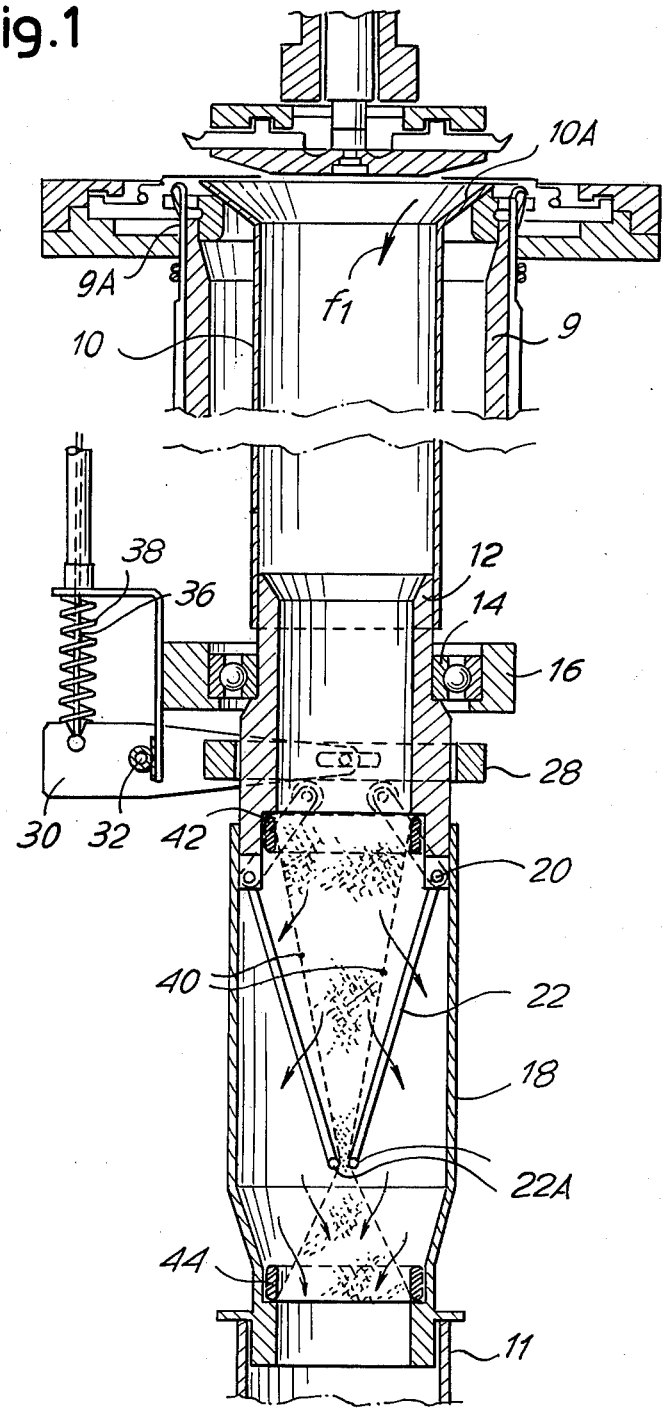
FIG. 1 is a fragmentary longitudinal section of a circular knitting machine incorporating a device for intercepting passage of an article being knitted.

There is shown in FIG. 1 a rotary needle cylinder of a circular knitting machine for knitting articles of hosiery such as stockings. Needles 9A are slidable in longitudinal grooves of the needle cylinder 9.

The reference numeral 10 indicates a tube which is held in the interior of the needle cylinder 9 and is connected at its top by a frusto-conical or other funnel shaped mouth 10A to the interior of the top edge of the needle cylinder where the article is knitted.

The tube 10 is either stationary or rotates with the needle cylinder 9, and an air current is created in the tube 10 to draw and tension the knitted article in the direction of the arrow $f_1$. The tube 10 forms a rectilinear continuation of a tensioning duct and extends coaxially with the needle cylinder over a length which in certain cases may be less than that of the article. Downstream of the tube 10, the tensioning duct comprises a non-rotating part 11 which is curved towards a horizontal portion of the tensioning duct. The knitted article being formed on the needle cylinder 9 and rotating with the cylinder must not touch the walls of the non-rotating curved part 11 because otherwise it will become twisted in an unacceptable manner. Devices exist for preventing such twisting, and retain the article during its formation such that it does not pass beyond the rotating linear portion of the tensioning duct. Such devices (generally known as anti-twist devices) serve to prevent the article, during its formation, from advancing beyond a certain distance along the rectilinear portion of the tensioning duct, at least part of which rotates, but they must also allow passage of the article along the tensioning duct when the article has been removed from the needles 9A of the needle cylinder 9.

In the embodiment shown in FIGS. 1 to 4, that part of the tensioning duct which rotates with the needle cylinder below the tube 10 is extended by means of a sleeve 12 which rotates with the needle cylinder and is supported by a bearing 14 from the machine structure 16. A tubular connection piece 18 is rigid with the sleeve 12, and has a lower narrow end 18A which extends into the inlet portion of the non-rotating part 11 of the tensioning duct. Even if the tensioning duct is fixed instead of rotating with the tube 10, the member 18 is made to rotate with the needle cylinder by means of a suitable drive.

Two retention members 22 are swing-mounted by pivots 20 on the lower end of the sleeve 12. Each of these members comprises a bar 22A at its free end inside the connection piece 18. External actuating arms 24 provided with roller ends 26 are engaged, on the outside of the rotating assembly formed by the sleeve 12 and connection piece 18, with the pivots 20 of the members 22. An actuating ring 28 slidable on the sleeve 12 but not rotating therewith is cooperable with the ends 26, and can be operated by a fork 30 pivoted at 32 and controlled, for example, by a tie rod 36 against the return action of a spring 38 which tends to raise the ring 28.

The ends of a very flexible tubular grid structure 40 are engaged, with the aid of rings 42, 44 or the like, both with the bottom of the sleeve 12 and with the connection piece 18 adjacent to the end 18A thereof. The structure 40 can be constituted by either very thin textile fabric, including net, or longitudinal filaments or the like which can prevent passage of the article but through which the air current can pass in order to provide suction even when the flexible grid structure 40 is displaced so that it intercepts the article in the duct.

Figure 2:
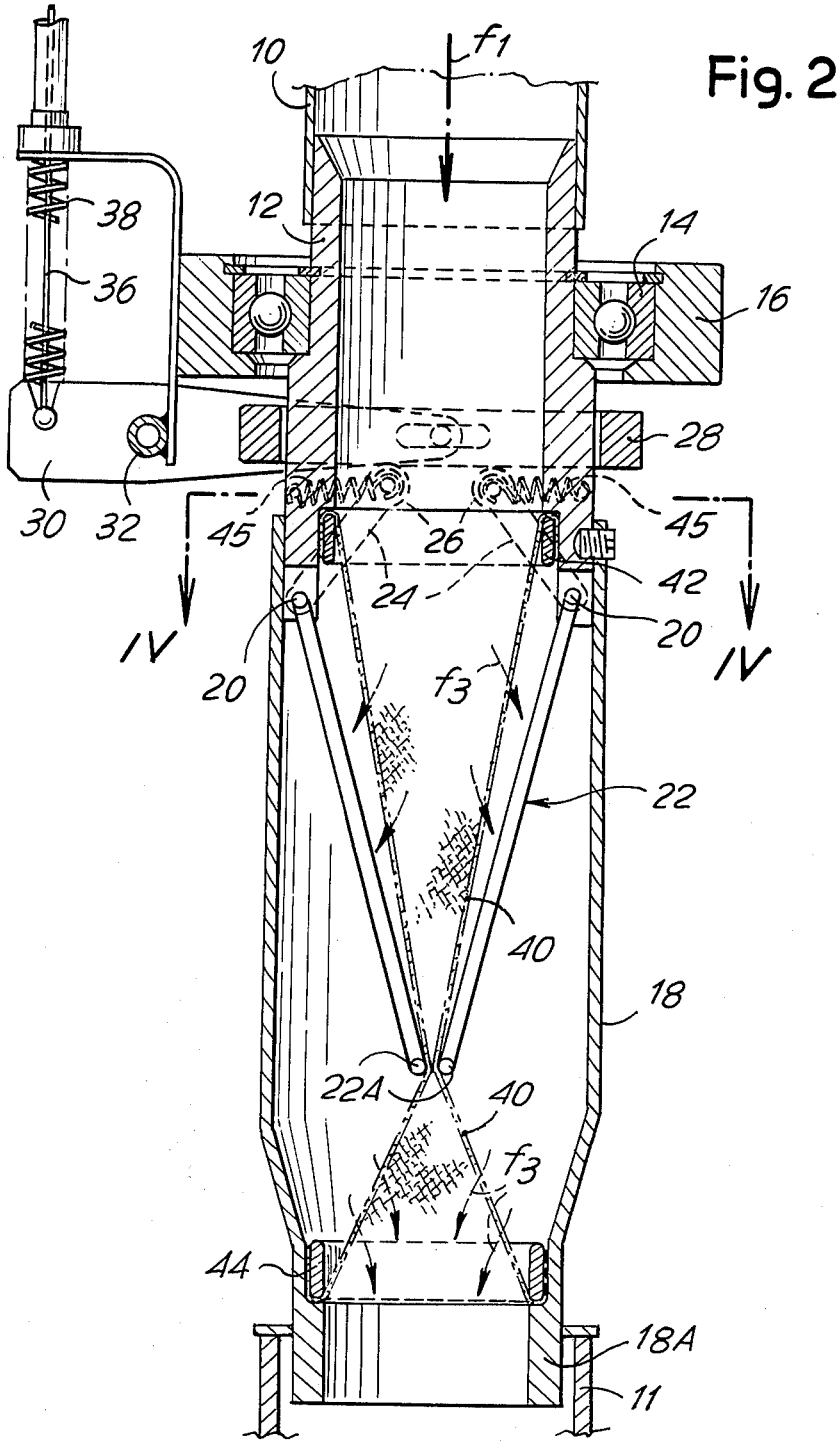
FIG. 2 is an enlarged section equivalent to FIG. 1.
Figure 3:
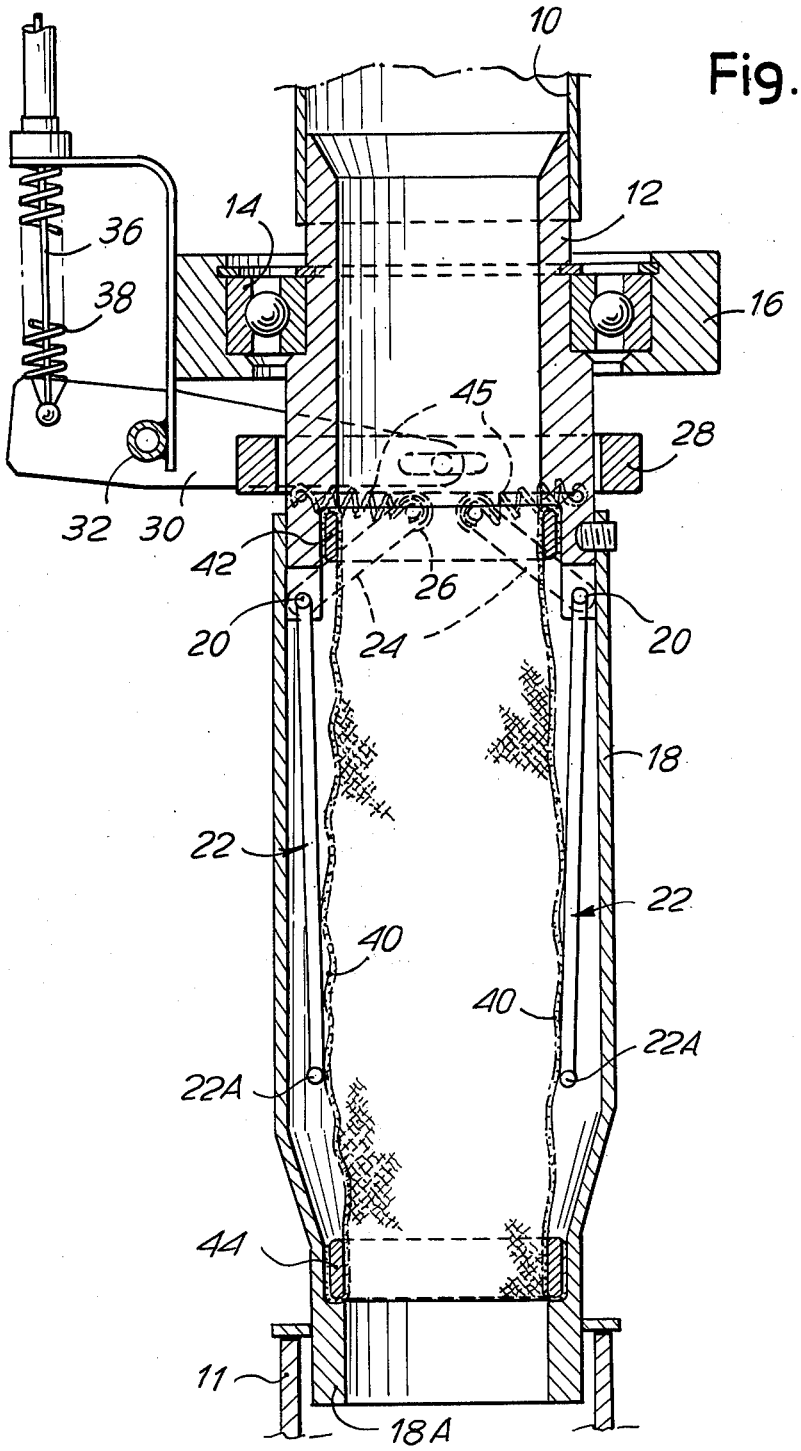
FIG. 3 is a section similar to FIG. 2, but showing the device when operated to permit passage of the article.
Figure 7:
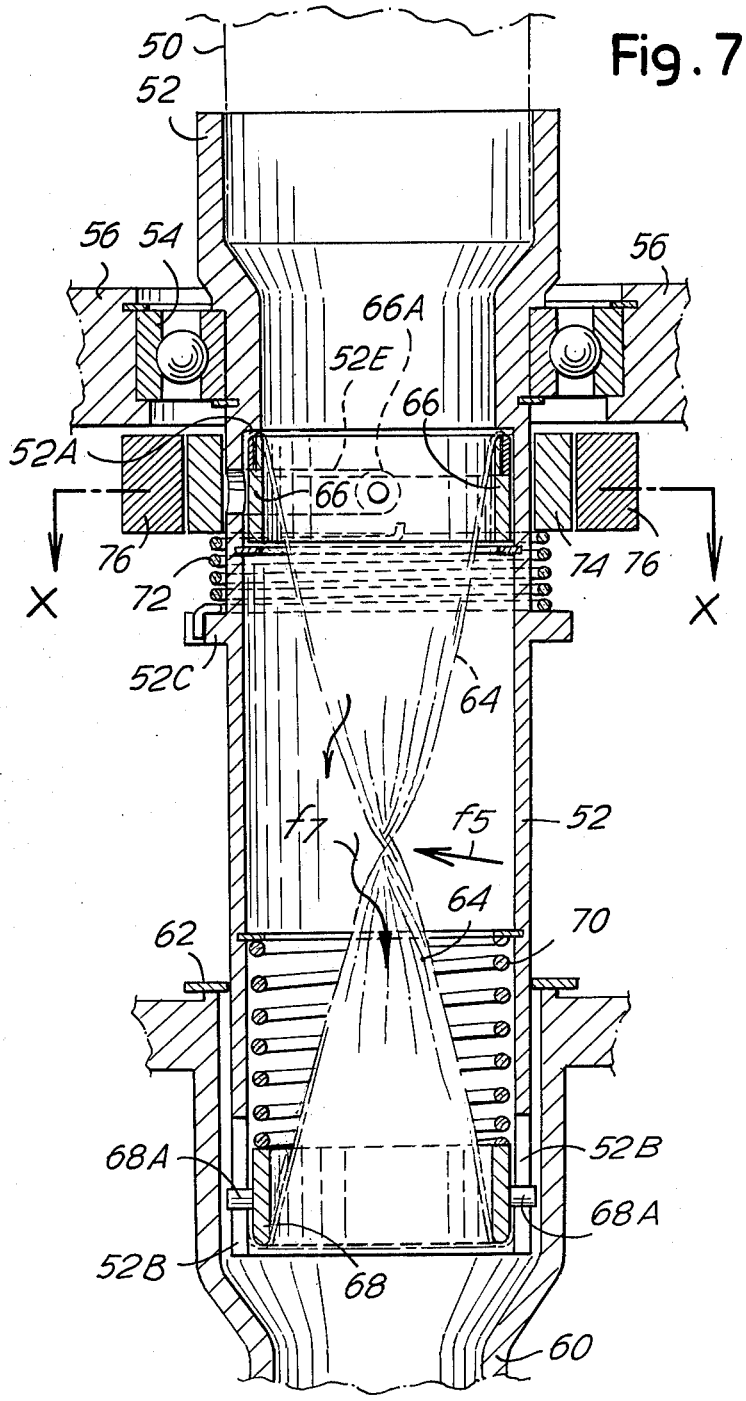
FIGS. 7 to 9 are fragmentary longitudinal sections of another embodiment of the device.
Figure 8:
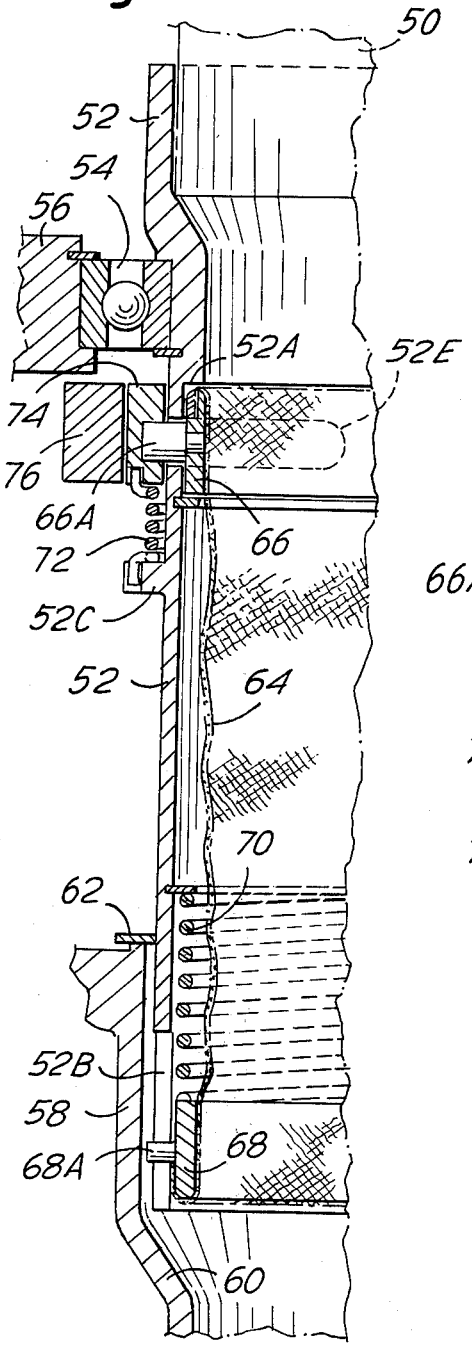
Figure 9:
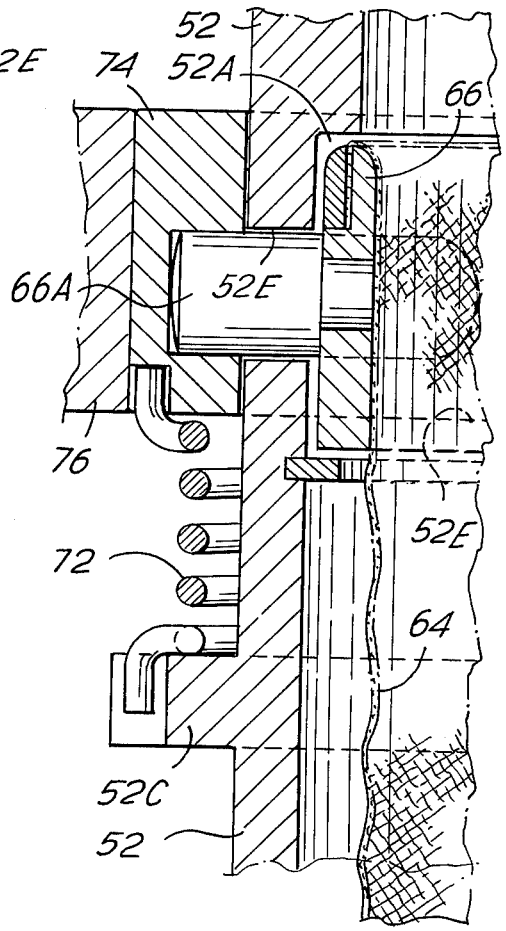
Figure 10:
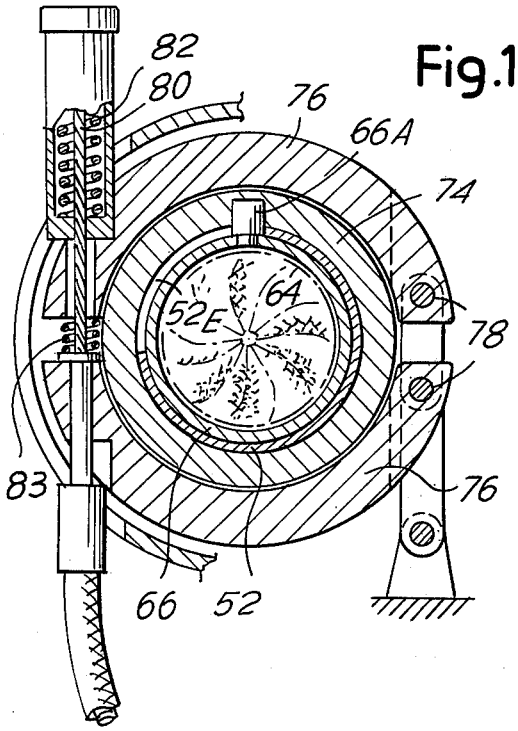
FIG. 10 is a section taken on line X—X of FIG. 7.

Under normal conditions (FIGS. 1, 2, 4), the retention members 22 are urged inwardly by springs 45 to push the grid structure 40 by means of the bars 22A from opposite sides, so that opposing zones of this structure approach each other and block the passage of the article through the duct so that the article is intercepted and held above the bars 22A which are adjacent as shown in FIGS. 1, 2 and 4. This represents the constricted state of the grid structure which, as shown in the drawings, resembles a net-like framework. The air traverses the structure 40 in accordance with the arrows $f_3$.

When knitting of the article on the machine has been completed, it has to be conveyed pneumatically along the duct formed by the assembly consisting of the members 10, 12, 18, 11. For this purpose the members 22 are temporarily drawn apart into the position shown in FIG. 3, and the grid structure 40 can then widen out to enable the retained article to pass. This represents the relaxed state of the grid structure or net framework. The structure 40 can be resilient so as to lie in the manner of a tubular wall, whereas the members 22 and bars 22A lie in a space defined between the structure 40 and connection piece 18, which is of greater cross-section than the rings 42, 44. In the construction illustrated, the bars 22A are caused to move apart, against resilient bias of the springs 45, by lowering the ring 28, which acts on the ends 26. The action of the ring 28 occurs very rapidly.

The connection piece 18 can be removed for inspection, or for replacing the structure 40, by removing the rings 42, 44, which can be rigidly connected together by rods positioned in such a manner as not to interfere with the movements of the members 22 and bars 22A.

The embodiment shown in FIGS. 5 and 6 comprises only one retention member 122 analogous to the members 22 but arranged to act only in one direction to cause the two opposing parts of the flexible grid structure 40 to approach a suitably shaped part 118 on the inner wall of the connection piece 18 and projecting inwards. The necessary control can take place in one of the ways already indicated, and under the same time conditions.

In the embodiment shown in FIGS. 7 to 10, the tube coaxial with the needle cylinder is indicated by 50, and extends downwardly from a funnel-shaped mouth at the upper end portion of the needle cylinder, and can rotate with the cylinder, the tube 50 constituting a first portion of a pneumatic tensioning duct. On the tube 50, there is mounted a sleeve 52 supported by a bearing 54 mounted on a fixed frame 56. The sleeve 52 rotates by the action of the tube 50 or by a suitable drive to provide synchronism with the needle cylinder. The lower ends of the sleeve 52 lies in an enlarged portion 58 of a non-rotating part 60 of the tensioning duct. A gasket 62 provides a pneumatic seal between the sleeve 52 and the end portion 58. The reference numeral 64 indicates a very flexible tubular grid structure, which is of textile filaments or the like, and which can also be of woven construction and serves for intercepting and retaining the article inside the tensioning duct.

The grid structure 64 (itself similar to a stocking) is engaged at the top with a ring 66 held in an angularly movable manner in an annular seat 52A provided in the sleeve 52. The grid structure 64 is engaged at the bottom by a ring 68, which is axially slidable with repsect to the sleeve 52, but is locked against angular movement relative to the sleeve 52 by means of at least one peg 68A which can slide in a corresponding axial slot 52B in the sleeve 52. A spring 70 urges the ring 68 downwards, that is away from the ring 66, the spring acting against the sleeve 52. The sleeve 52 comprises an outer collar 52C, in which is engaged the end of a torsion spring 72 which extends helically around the sleeve 52, its other end being engaged in a ring 74 idly mounted on the sleeve 52. The ring 74 is engaged with the ring 66 inside the sleeve 52 by means of a peg 66A, which can slide in a slot 52E provided in the sleeve 52 over a limited angle, for example 120°. A braking member for the ring 74 is provided on the fixed structure external thereto, and is either in the form of a simple shoe or a pair of jaws 76. These jaws are hinged at 78 to a fixed support element, and are controlled by a flexible cable 80 by means of a spring 82, so that they rest against the ring 74 with a slight pressure (due to the characteristics of the spring 82) when the flexible cable 80 is pulled. Resilient return means 83 urge the jaws apart.

When the ring 74 is not braked, it rotates together with the sleeve 52. In addition, together with the ring 66 it is urged by the torsion spring 72 in the same direction of rotation, towards one end of the angular slot 52E. Under these conditions the grid structure 64 is twisted, and therefore becomes narrowed so that it closes together inside the tensioning duct in the zone indicated by the arrow $f_5$ in FIG. 7 to intercept the article travelling in the tensioning duct. The suction air current traverses the flexible grid structure twice as indicated by the arrows $f_7$. The fact that the ring 68 can rise against the resilient return thrust of the spring 70 ensures that the grid structure 64 (which can also consist of longitudinal filaments) will be twisted to a sufficient extent. The force of the torsion spring 72 is such as to angularly urge the ring 66 forwardly in the direction of the assembly 50, 52, i.e. of the needle cylinder, to attain the twisted state of the grid structure 64.

The twisted constricted state of the structure 64, and consequently the interception of the article under formation, must cease for a short time when the article leaves the needles of the needle cylinder, the article then having to be pneumatically conveyed through the fixed part of the pneumatic tensioning duct which starts at the part 60. This is attained by lightly braking the ring 74, thus causing the assembly 74, 66A, 66 to retard its angular movement with respect to the sleeve 52 and consequently to the ring 68, so that the peg 66A moves until it strikes against the end of the angular slot 52E at the opposite end to that towards which the spring 72 normally urges the assembly 74, 66A, 66. The result of this is that the grid structure 64 takes on a cylindrical, i.e. straightened or relaxed state, so that it is no longer constricted in the zone $F_5$, and the structure 64 no longer intercepts the article. As soon as the braking action, provided by the friction on the ring 74 ceases, the assembly 74, 66A, 66 urged by the spring 72, returns to its advanced position with respect to the continuously rotating assembly 50, 52, to again twist the grid structure 64 so as to intercept the article which is about to be kitted on the machine.

In a modification (not shown) two or more brake shoes could act directly on the ring 66 through a greater number of slots 52E of suitable extension and distribution.

Figure 11:
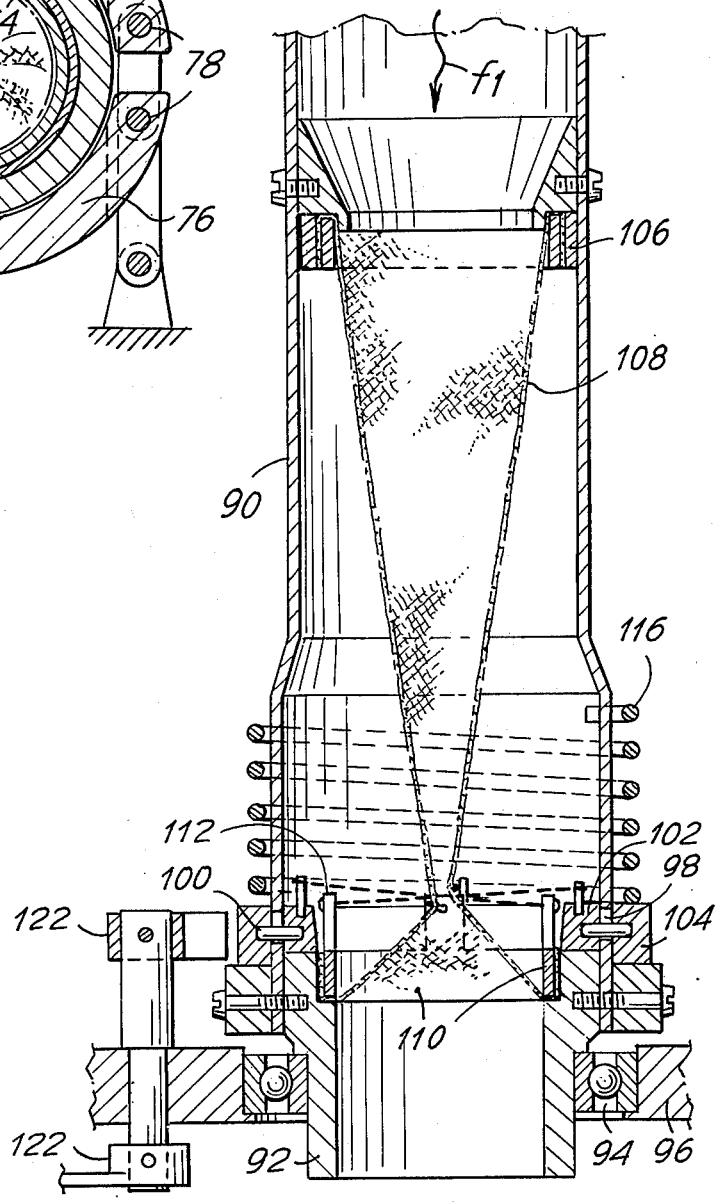
FIG. 11 is a fragmentary longitudinal section of yet another embodiment.
Figure 12:
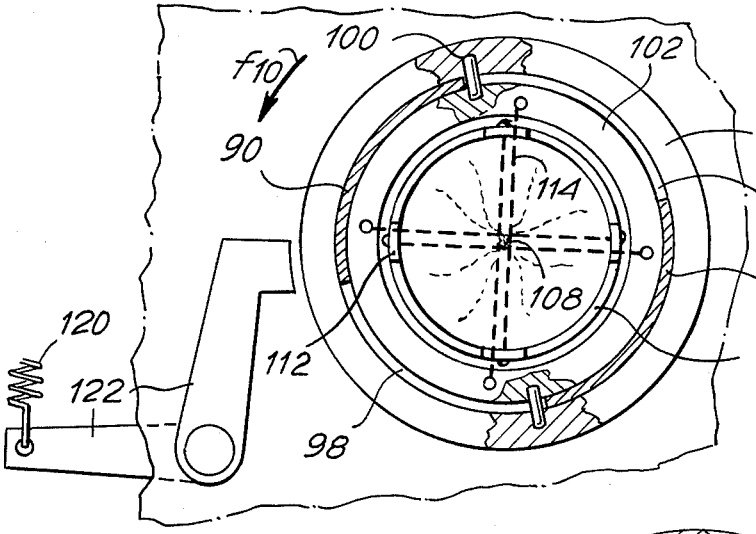
FIGS. 12 and 13 are horizontal sections through the device of FIG. 11 and respectively showing the device when intercepting passage of the article and when permitting passage of the article.
Figure 13:
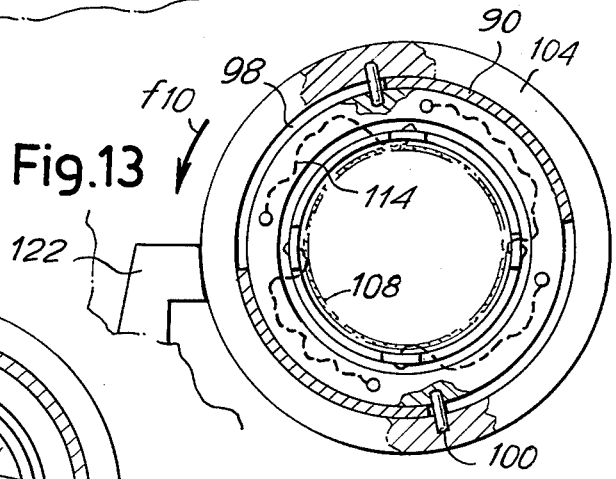

In FIGS. 11 to 13, the reference numeral 90 indicates the connection tube which rotates coaxially with the needle cylinder and extends below the needle cylinder. The lower end of the tube 90 is fitted to a connection piece 92, mounted by means of a bearing 94 on a fixed support 96 of the machine frame. An inner annular element 102 and an outer annular element 104 are connected together by radial pins 100 passing through transverse slots 98 in the tube 90, and can make relative angular movements about the cylindrical wall of the tube 90.

The upper end of a flexible tubular grid 108 is fixed to the tube 90 at 106, whereas its lower end is engaged with a ring 110 rigid with the connection piece 92. The ring 110 comprises four upper appendices 112, with each of which is engaged one end of a wire 114. The other end of each wire is engaged with the annular element 102. A torsion spring 116 is provided having its opposite ends suitably connected to tube 90 and outer annular element 104. The manner of connection, for example, may be similar to that provided with reference to the embodiment of FIGS. 7–10 in describing the connection of spring 72 to sleeve collar 52C and to ring 74. The spring 116, acting between the movable assembly 90, 92 and the annular elements 102, 104 urges the elements 102, 104 in the direction of the arrow $f_{10}$, to bring the pins 100 into contact with the front end of the respective slots 98, with respect to the direction of rotation as indicated by the arrow $f_{10}$. In this position (see FIG. 12), the individual wires 114 are taut in an approximately diametrical position, and tighten or constrict the flexible tubular grid 108 towards its centre, thus blocking passage of the article.

When the article is to be discharged, a resilient rod 120 is caused to act on a lever 122, which acts via a brake block on the outside of the element 104, so braking it slightly, and overcoming the torsional action of the spring 116, until the elements 102, 104 are angularly retarded by the length of the slots 98. The position shown in FIG. 13 is thus attained, in which the wires 114 slacken, as the ends of the wires approach each other. The flexible tubular grid 108 can thus relax and open out to allow passage of the article. When the braking action of the lever 122 is interrupted, the spring 116 urges the elements 102, 104 forwards, until the wires 114 become taut in the position shown in FIG. 12.

Figure 14:
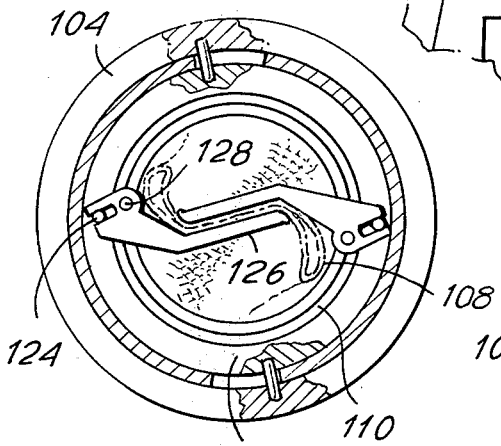
FIGS. 14 and 15 are sections similar to FIGS. 12 and 13 showing yet a further embodiment.
Figure 15:
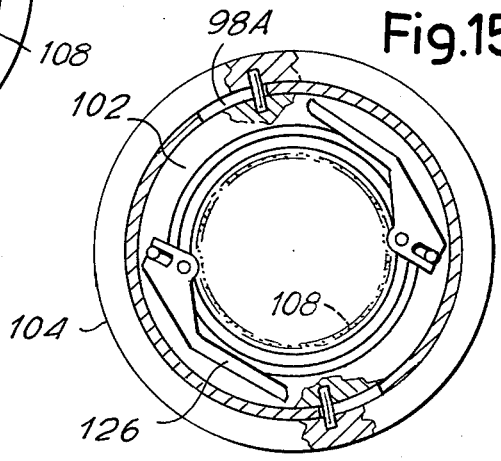

FIGS. 14 and 15 show one modification in which the two annular elements 102, 104 comprise pegs 124 which engage in slots in opposed lever arms 126 pivoted at 128 to the element 110, which in this case does not comprise the appendices 112. When the ring 104 is not braked, the spring 116 urges the opposed surfaces of arms 126 to come together and assume the approximately diametrical position shown in FIG. 14, so that they squeeze and constrict the flexible tubular grid 108 between them. When the ring 104 is lightly braked, the movable assembly 104, 102 becomes retarded, as do the pins 100, over the length of the slots 98A (which are equivalent to, but shorter than, the slots 98), so causing the arms 126 to withdraw from each other as shown in the position of FIG. 15, so as to allow passage of the article within the now relaxed flexible grid 108.

What is claimed is:

1. In a circular knitting machine, a rotating needle cylinder, a pneumatic tensioning duct along which an air current passes to tension an article being knitted, said duct comprising a rotating portion, a flexible textile net defining a tubular framework in the rotating portion of the tensioning duct, said net framework being deformable between a constricted state whereby it intercepts the article under formation and a relaxed state whereby it permits the knitted article to pass therethrough, and means operable to constrict the framework so that it intercepts the article under formation while the air current is maintained through the framework.

2. A circular knitting machine as claimed in claim 1, wherein the tubular framework is resiliently urged so that it distends axially.

3. A circular knitting machine as claimed in claim 1, wherein the said means operable to constrict the tubular framework comprises at least one movable member mounted on the rotating duct portion, and means for moving said member to cause said member to push one wall portion of the framework towards a diametrically opposed wall portion whereby to constrict the framework.

4. A circular knitting machine as claimed in claim 3, wherein there are two said movable members located symmetrically with respect to the tubular framework, said members being movable symmetrically.

5. A circular knitting machine as claimed in claim 3, wherein said movable member is swing-mounted and comprises an actuating arm located externally of the rotating duct portion, and said means operable to move said member comprises means movable axially of the duct to act on the actuating arm of the member.

6. A circular knitting machine as claimed in claim 1, wherein the means operable to constrict the tubular framework comprises a rotary annular element engaged with one end of the framework, said annular element being angularly movable to cause the framework to be constricted by torsional effects.

7. A circular knitting machine as claimed in claim 6, further comprising resilient means angularly biasing the annular element in a direction to maintain the tubular framework under torsion, and means for selectively imparting a braking action to said annular element so that it moves relative to the rotating duct portion in a direction to remove the constriction and move the tubular framework to its relaxed state.

8. A circular knitting machine as claimed in claim 1, wherein the said means operable to constrict the tubular framework comprises an annular element which is movable angularly with respect to the rotating duct portion, resilient means urging the annular element in one direction relative to the rotating duct portion, brake means for moving the annular element relative to the rotating duct portion in a direction opposite to said one direction, and members associated with the annular element and with the rotating duct portion and movable between a retracted position in which they do not interfere with the tubular framework, and a projecting position in which they constrict the tubular framework.

9. A circular knitting machine as claimed in claim 8, wherein said members comprise opposed pivotal levers which come together along a diameter in order to constrict the tubular framework.

10. A circular knitting machine as claimed in claim 8, wherein said members comprise wires which are engaged with the rotating duct portion and with the annular element, and which can become disposed approximately diametrically in order to constrict the tubular framework.

* * * * *